US006450185B1

(12) United States Patent
Sallinen

(10) Patent No.: US 6,450,185 B1
(45) Date of Patent: Sep. 17, 2002

(54) PAINT ROLLER COVER WASHER

(76) Inventor: Robert A. Sallinen, 9748 Middle Creek Rd., Upper Lake, CA (US) 95485

( * ) Notice: Subject to any disclaimer, the term of this patent is extended or adjusted under 35 U.S.C. 154(b) by 0 days.

(21) Appl. No.: 09/938,398

(22) Filed: Aug. 23, 2001

(51) Int. Cl.[7] ..... B08B 3/02
(52) U.S. Cl. ..... 134/138; 134/900
(58) Field of Search ..... 134/900, 138

(56) References Cited

U.S. PATENT DOCUMENTS

| | | | | | |
|---|---|---|---|---|---|
| 2,831,488 | A | * | 4/1958 | Anderson | 134/900 X |
| 2,938,368 | A | * | 5/1960 | Bixel | 134/900 X |
| 2,985,178 | A | * | 5/1961 | Christensen | 134/900 X |
| 4,130,124 | A | | 12/1978 | Sherwin | |
| 4,672,987 | A | * | 6/1987 | Brandt | 134/900 X |
| 5,005,598 | A | * | 4/1991 | Hodgdon | 134/900 X |
| 5,363,869 | A | | 11/1994 | McDowell | |
| 5,413,133 | A | | 5/1995 | Russell | |
| 5,651,381 | A | * | 7/1997 | Balouchian | 134/900 X |
| 5,839,459 | A | | 11/1998 | Bisby | |
| 6,019,111 | A | | 2/2000 | Gillies | |

* cited by examiner

*Primary Examiner*—Philip R. Coe
(74) *Attorney, Agent, or Firm*—Larry D. Johnson; Craig M. Stainbrook; Johnson & Stainbrook, LLP

(57) ABSTRACT

A roller cover washer is provided, including a hollow pipe handle connected by a swivel-type adaptor to a water supply. The handle terminates in a water outlet end including a threaded end coupled to a T-connector and having pipe extensions perpendicular to the handle and capped at their ends. The water outlet end is covered by a cylindrical housing partly closed at each end by semicircular splash shields. Each pipe extension includes a plurality of apertures adapted to direct a fanned spray of water at an angle onto the roller's circumference. A roller cover on a roller assembly can be inserted into the housing pipe through either of the openings at the ends. When in use, the roller spins rapidly as paint is diluted and forced from the cover both by the water spray and by the centrifugal force induced from the spinning roller. Paint and water are ejected from the cover and drain into the housing and out the open ends of the housing.

2 Claims, 3 Drawing Sheets

PAINT ROLLER COVER WASHER

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

1. Technical Field

The present invention relates generally to paint roller cover cleaning devices, and more particularly to a lightweight portable roller cleaning apparatus adapted for hookup to a variety of standard household water faucets and capable of rapid water-based paint roller cleaning with minimum mess.

2. Background Information and Discussion of Related Art

The use of a paint roller provides an efficient and clean method of applying paint to surfaces. However, as anyone who has painted with a roller knows, cleaning the roller cover after use is another matter. By design roller covers absorb a considerable volume of paint. Accordingly, experienced painters develop a feel for the most effective volume of paint to absorb into the cover before applying paint to the surface. Generally, the roller material is first substantially saturated with paint; then an excess is rolled into cover and the excess is rolled onto the surface. This takes advantage of the bonding properties of paints, which adhere more readily to dry surfaces than to the paint itself, but not so much so that the paint will readily migrate from the roller cover material to the surface when the roller's supply of paint nears exhaustion. Thus, while much of the excess paint can be expressed onto the painting surface, a large amount also remains in the roller nap, particularly in thick and long naps.

Cleaning a roller cover is a time-consuming task, frequently quite messy, and for the professional actually constitutes a waste of labor and money. In consequence, the professional is as likely as not to simply discard the roller cover after a first use. The non-professional also tends to avoid the inconvenience of cleanup, because the time it takes to clean a roller outweighs the any cost savings realized from avoiding a new purchase, particularly in view of the long periods of time between painting. Because even poorly made paper tube roller covers can easily be designed to work effectively in repeated uses, if a rapid and effective means of cleaning a roller cover is devised, discarding a roller after a single use would be economically and environmentally irresponsible. Thus, it is desirable to have a quick, effective, cost-effective means for cleaning paint from roller covers in order to realize both economic and environmental benefits.

To this end, several devices have been proposed to solve the roller cover cleaning problem. For example, U.S. Pat. No. 4,733,679 to Dolcater, teaches an apparatus for cleaning a paint roller cover removed from its handle. The apparatus has a cylindrical housing with a transverse end wall at one end carrying a tubular bushing and an opening at the opposite end. A shaft is snugly but slidably received in the end wall bushing and it extends longitudinally inside the housing and terminates short of the housing's end opening. A support for a roller cover is rotatably mounted on the shaft. This support can be slidably assembled frictionally to a paint roller cover. The assembled paint roller cover, support and shaft can be inserted and removed as a unit through the end opening of the housing. A water spray tube inside the housing sprays water onto the roller cover on the support and shaft.

U.S. Pat. No. 5,409,027 to Glunt, teaches a roller cleaning apparatus utilizing plural sprays which turn and clean supported rollers in a cylindrical container extending vertically from the bottom wall to the top. The container includes a lid over the top. The bottom wall is configured to allow the discharge of fluid. The container also includes legs to support the container in its vertical orientation. A support mechanism is vertically positioned in the center of the container and adapted to receive the interior surface of a paint roller to be cleaned. A manifold assembly includes a vertically extending first manifold and support mechanisms with radially extending apertures. A pair of exterior vertically extending manifolds, parallel to the first manifold and adjacent to the interior faces of the side walls, define the space between the exterior manifolds for the receipt of the roller to be cleaned. The exterior manifolds have radially extending apertures for water to spray on the exterior surface of the roller, offset from its center. A horizontal coupling manifold is connected to the lower ends of the vertical manifolds with a region thereof extending through the container for selective coupling to a hose.

U.S. Pat. No. 5,337,769 to Howe, discloses a paint roller cover cleaning device comprising a drum with a perforated base, a cylindrical sidewall and an open top fitted with a removable lid. The device has a support that frictionally engages a paint roller cover rotatably secured to the base of the drum. The cylindrical sidewall has a vertical slot opening that allows the user to selectively direct a pressurized stream of solvent from a nozzle against the outer periphery or nap of the paint roller cover.

U.S. Pat. No. 5,033,491 to Middleton, teaches a roller cleaner comprising a doublewalled, tubular vessel configured with a central cavity into which a paint roller can be placed for washing while the roller cover is mounted on a handle frame. A hose fitting enables connection to an indoor faucet or spigot, or to a pump to provide pressurized water to the double walled shell manifold from which the liquid sprays through openings in the inner wall into the cavity, striking the roller tangentially. The nap of the roller cover is caused to spin on its handle.

U.S. Pat. No. 5,487,399 to Hannah, teaches a roller cleaner having a hollow tubular housing with a freely rotatable support frame for holding a paint roller pad for cleaning. The housing is closed at one end and includes a series of openings down one side. A movable spraytube on the outside of the housing includes a series of spray jets which correspond to the openings to spray water into the housing. The spray tube moves to allow the user to change the direction of the water spray before or during cleaning in order to vary the speed and/or direction of the rotating roller pad inside. A second spray tube having a series of spray-openings is fixed on the center shaft of the rotating internal support frame. A valve on the outside spray tube allows the user to adjust the flow of water to the sprayers.

U.S. Pat. No. 4,708,152 to Hibberd, discloses a paint roller cleaning device wherein the roller to be cleaned is shoved over a roller holder which is rotatably mounted in a vertical position in a container such as an open top bucket. Fan type jets are supported from an inlet water manifold and adjusted in position to direct a thin wall of water essentially tangentially against the paint roller to cause the roller to rotate and to contact every point on the roller to cause the roller to spin. Means are provided to connect a garden hose directly to the vertical manifold.

Although the foregoing patents disclose useful devices, all require that the roller cover be removed from the roller itself before cleaning. Accordingly, one of the messiest aspects of cleaning a roller is not surmounted with these devices. It is thus preferable to have a device that cleans a roller cover while still on the handle. Several other patents are illustrative of this art. For instance, U.S. Pat. No. 5,005,598, to Hodgdon, teaches a paint roller rinser having an elongated tubular housing enclosed on both open ends with housing end walls, and lengthwise horizontally disposed when used. Each housing end wall contains a small fluid discharge opening for elimination of fluid and paint residue. A living hinge attached door over an opening allows the insertion of a roller cover. A pressurized fluid distribution system within the housing has a plurality of fluid emission nozzles that can be manually positioned to rotate a roller brush first in one direction then another. Support members prevent housing rolling and support the rod section of the roller during cleaning.

U.S. Pat. No. 5,413,133 to Russell, shows a paint roller cleaning device including a housing with a cover to hold the paint roller cover on the inside. A spray tube inside the housing directs water onto the cylindrical brush of the paint roller causing the cover to centrifugally eject water and paint.

U.S. Pat. No. 4,130,124 to Sherwin, discloses a paint roller cleaner comprising a bifurcated elongate housing for supporting a paint roller. An inlet manifold extends along a wall of the housing chamber and has a portion extending through a housing wall for connection to a source of cleaning liquid under pressure. Within the chamber, the manifold has outlet openings to direct cleaning liquid toward a paint roller supported in the chamber. The manifold is movable to direct liquid at different angles toward the paint roller. The housing members provide a discharge opening through which the cleaning liquid escapes from the chamber. A valve arrangement is provided for admission of air under pressure to the manifold, for drying of a cleaned paint roller within the chamber.

U.S. Pat. No. 4,672,987 to Brandt, teaches a roller cleaner having a vertically oriented tubular housing having an open top through which the roller is inserted into the housing for washing, and having an open bottom through which used washing fluid and material exit the housing. A sprayer assembly is provided for directing a stream of washing fluid against the roller when disposed within the housing to clean and rotate the roller on the handle.

U.S. Pat. No. 6,019,111, to Gillies, discloses a paint roller cleaning system which includes a housing, covers on two opposing open ends, a centrally positioned notch, a dispensing tube having a plurality of nozzles extending through one cover through an aperture and in fluid communication with a conventional garden hose. Water supplied to a hose coupler is dispensed through the nozzles to the outside edge of a paint roller, thereby causing the roller cover to rotate while the user lowers and raises the dispensing tube to saturate the roller cover.

Finally, U.S. Pat. No. 5,839,459 to Bisby, teaches a paint roller cleaning apparatus comprising a hollow pipe with notches formed at the lower end to permit fluid to escape from the interior of the pipe. A tubular spray arm is rotatably mounted within the pipe and has a plurality of vertically aligned and spaced apart apertures to spray water along the length of a paint roller cover positioned within the pipe. An elbow at the top of the paint arm projects from the pipe and is connected by a flexible hose to a water source. A clip on the exterior of the pipe grips the support rod of a paint roller, and a slot in the upper edge of the pipe receives the support rod so that the paint roller is journaled in a vertical orientation with the roller's longitudinal axis parallel to the longitudinal axis of the spray arm.

As will be readily appreciated, there are considerable similarities in all of the foregoing art. A consistent and recurrent theme is the use of a forceful water spray to the outer edge of a roller cover to both dissolve the paint and to rotate the cover, inducing centrifugal forces to eject paint from the roller into a housing to contain and direct the waste paint solution. The devices are of varying convenience to use, but none accomplishes the desired task with the simplicity, efficacy, economy, and rapidity of the present invention.

BRIEF SUMMARY OF THE INVENTION

The roller cover washer of the present invention cleans a roller cover without the need to remove the roller cover from the roller assembly. The cleaner comprises a hollow pipe handle connected by a swivel-type adaptor to a water supply. The handle terminates in a water outlet end which includes a threaded end coupled to a T-connector and having pipe extensions perpendicular to the handle and capped at their ends. It is secured in the housing by a locking collar. The water outlet end is covered by a cylindrical housing partly closed at each end by semicircular splash shields. Each pipe extension includes a plurality of apertures adapted to direct a fanned spray of water at an angle onto the roller's circumference.

A roller cover on a roller assembly can be inserted into the housing pipe through either of the openings at the ends. When in use, the roller spins rapidly as paint is diluted and forced from the cover both by the water spray and by the centrifugal force induced from the spinning roller. Thus, paint and water are ejected from the cover and drain into the housing and out the open ends of the housing.

DETAILED DESCRIPTION OF THE INVENTION

Figure 1:
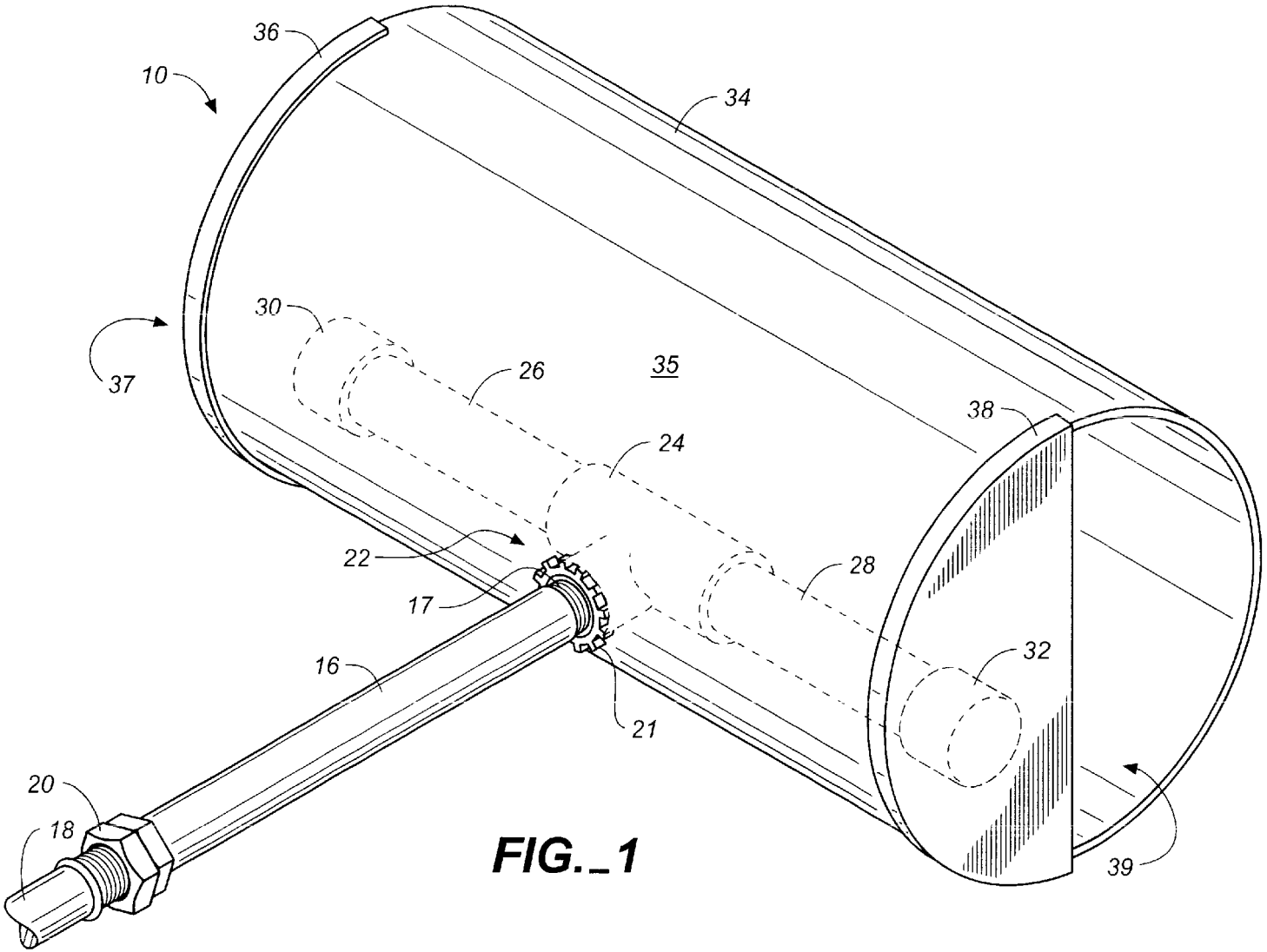
FIG. 1 is a perspective view of the paint roller cover washer of the present invention.
Figure 2:
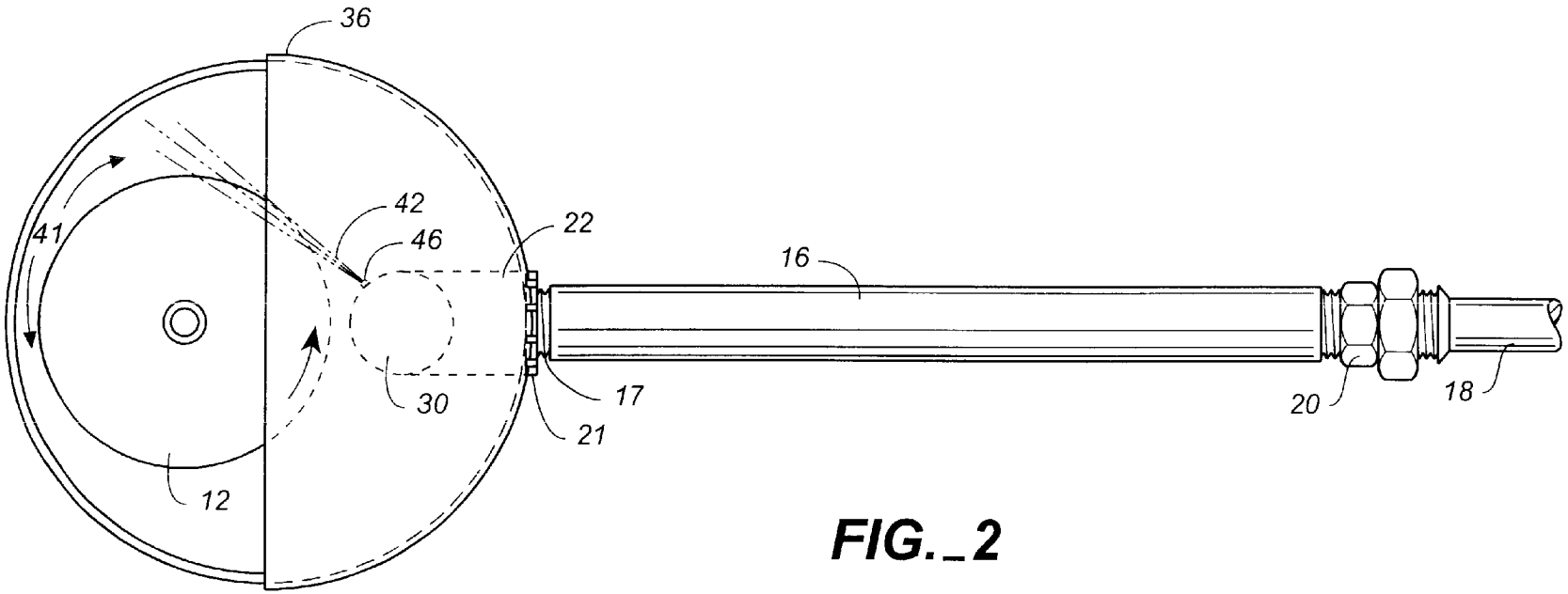
FIG. 2 is a side view in elevation of the paint roller cover washer.
Figure 3:
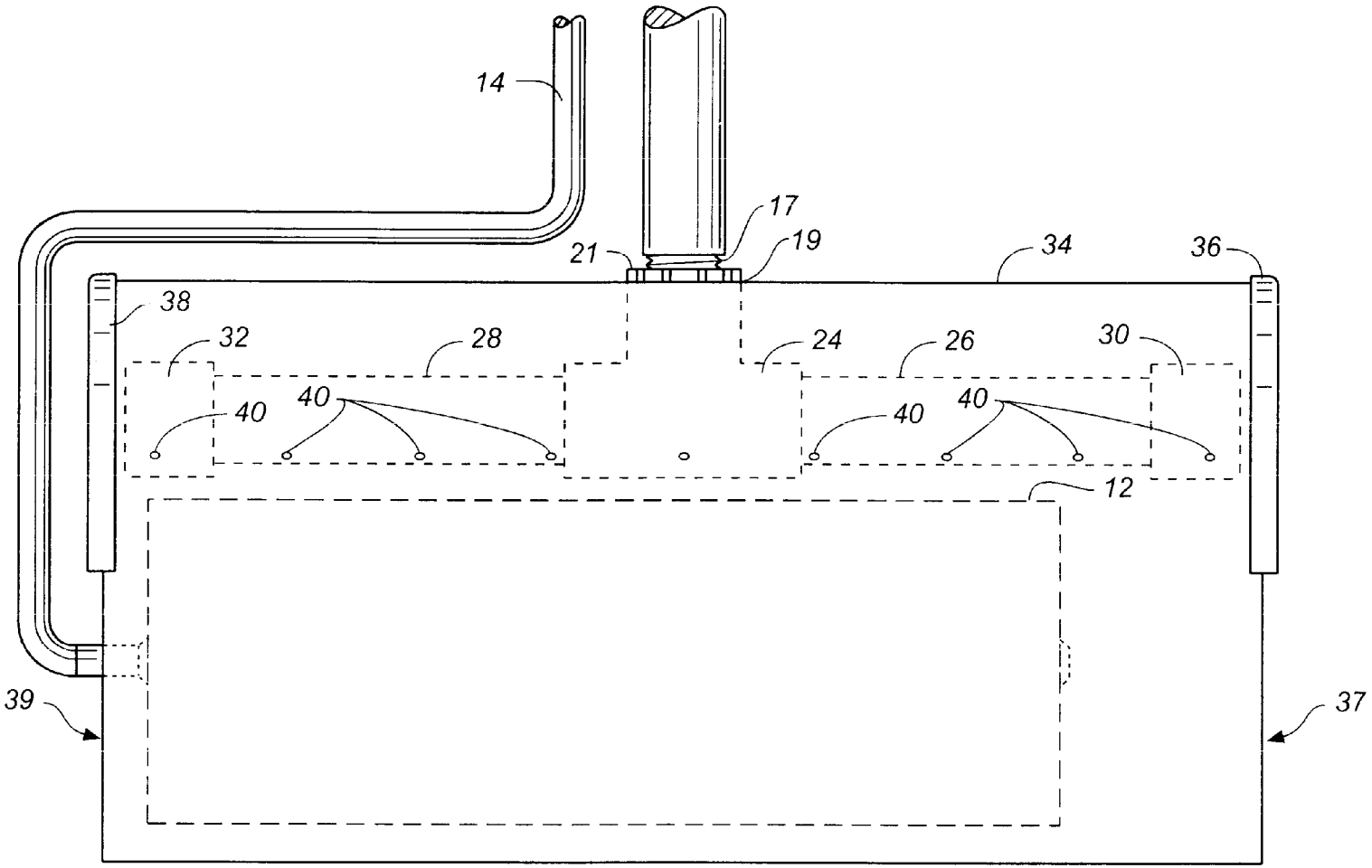
FIG. 3 is a top plan view of the inventive apparatus showing the water outlet end of the water source in phantom.

Referring to FIGS. 1 through 3, wherein like reference numerals refer to like components in the various views, FIG. 1 is a perspective view of the paint roller cover washer of the present invention. FIG. 2 is a side view in elevation of the paint roller cover washer. FIG. 3 is a top plan view of the inventive apparatus. These views collectively show that the paint roller cover washer apparatus 10 of the present invention cleans a roller cover 12 while the roller cover is still on the roller assemblyl 4. The cleaner comprises a handle portion 16 made of pipe which is in fluid communication with a water supply source 18 (preferably a conventional garden hose) and is connected thereto with a swivel-type female hose adapter 20. The handle is preferably schedule 40 polyvinylchloride (PVC), though a wide variety of other materials and sizes may be quite suitable.

Handle portion 16 is preferably elongate and terminates at a water outlet end 22, which includes a threaded end 17 of handle 16 coupled to a PVC T-connector 24. Extending at substantially right angles to handle portion 16 are two extensions 26, 28 which function as water outlet pipes, each of the pipes having a cap 30, 32 at their respective ends, either threadably connected or chemically bonded.

The water outlet end 22 is covered by a housing 34, preferably generally elongate and cylindrical in shape, thus having at least one side 35. The housing is partly closed at each of its ends by planar, semicircular cover plates or splash shields 36, 38. A standard roller cover of approximately nine inches in length and 1½ in diameter, while still on a roller assembly, can be inserted into the pipe through either of the openings 37, 39 at the respective ends. The threaded end 17 of handle portion 16 is threadably inserted through an opening 19 in housing 34 where it is secured by a locking collar 21 and a gasket (not shown).

Each extension 26, 28 includes a plurality of apertures 40 bored through the extensions and adapted to direct a spray of water 42 at high pressure at an angle comprising a chord to the roller's circumference 44 and onto the surface of the roller cover 12. Nozzles to spread and fan the spray may be fitted into apertures 40.

Because of the angle at which the water spray strikes the roller cover, the roller spins rapidly as paint is diluted and dissolved by the solvent, and centrifugal force ejects paint and water from the cover material. When one side is completed, the roller assembly can be removed from the housing and the roller cover inserted into the opposite end of the cleaner so that the roller cover can be cleaned more thoroughly by directing water against the nap in the direction opposite the direction it was first directed onto the roller. If desired, the cleaning process can be completed with the housing in either a horizontal or a vertical orientation. In the former case, the roller is manually retained in position and water and paint drain from both openings at the ends of housing 34. In the latter case, the roller can be supported on the edge of the housing and water can be more carefully discharged from one end of the housing to direct the effluent into a disposal container or environmentally acceptable drainage system.

It is this ease and simplicity of use that is unique to the instant invention. Unlike devices in the prior art, which clean either uni-directionally or which require messy and cumbersome changes in the orientation of water nozzles, the present invention permits a seamless and almost instantaneous change from one end of the housing to the other, thus enabling comprehensive cleaning of the roller cover. Furthermore, the paint roller cleaning apparatus of the instant invention can be fabricated from inexpensive off-the-shelf PVC components readily available in an ordinary hardware store. For example, in a first aspect, handle 16 is fabricated of ½ inch schedule 40 PVC approximately one foot in length. Adaptor 20 is a readily available swivel-type female adaptor. Locking collar 21 is a standard electrical type lock nut. T 24 comprises a ½ inch PVC tee, and extensions 26, 28 are ½ inch schedule 40 PVC with ½ inch PVC caps. Housing 34 is a 6 inch diameter PVC pipe of approximately one foot in length. And the apertures in extensions 26, 28 are simply 1/16th inch holes bored through the extensions and fitted with spray nozzles 44, if desired.

While this invention has been described in connection with preferred embodiments thereof, it is obvious that modifications and changes therein may be made by those skilled in the art to which it pertains without departing from the spirit and scope of the invention. For example, it would be obvious to replace the substantially cylindrical housing with a housing of a different shape and partly capped at its open ends with correspondingly shaped covers. The choice of PVC pipe circular in cross section advances the interest of keeping fabrication costs to a minimum, but alternative shapes would not affect the fundamental principles of the invention. Additionally, the dimensions are preferred dimensions suited for use with conventional roller covers, though larger covers could be cleaned using a suitably sized apparatus having precisely the same characteristics and features. Such a variation might include a housing sized to accommodate the longer 18 inch rollers commonly used by commercial painters. Accordingly, the scope of this invention is to be limited only by the appended claims.

What is claimed as invention is:

1. A paint roller cover washer, comprising:

a generally elongate and cylindrical housing having at least one side with an opening, and two open ends, said open ends including openings of sufficient size to permit a roller cover to be inserted into the openings, said ends partly covered by planar and semicircular splash shields;

a handle fabricated of elongate hollow pipe and having a water supply end and a water outlet end disposed within said housing, said handle inserted through the opening in said side of said housing; and water outlet means in fluid communication with said water outlet end of said handle, said water outlet means including a section of water outlet pipe substantially perpendicular to said handle and having a plurality of apertures for directing a spray of water onto the outer circumference of a paint roller cover when said roller cover is inserted into one of the open ends of said housing.

2. A paint roller cover washer, comprising:

a housing having at least one side with an opening, and two open ends, said open ends including openings of sufficient size to permit a roller cover to be inserted into the openings;

a handle fabricated of elongate hollow pipe and having a water supply end and a water outlet end disposed within said housing, said handle terminating in a threaded end threadably inserted through the opening in said side of said housing, said handle secured to said housing by a locking nut and washer; and water outlet means in fluid communication with said water outlet end of said handle, said water outlet means comprising a T-connector connected to said threaded end of said handle, said T-connector, including a section of water outlet pipe substantially perpendicular to said handle and having a plurality of apertures for directing a spray of water onto the outer circumference of a paint roller cover when said roller cover is inserted into one of the open ends of said housing, and first and second water outlet pipe extensions at substantially right angles to said handle portion, said extensions having caps at their respective ends.

* * * * *